US010240541B2

(12) United States Patent
Eastman

(10) Patent No.: US 10,240,541 B2
(45) Date of Patent: Mar. 26, 2019

(54) METHODS AND SYSTEMS FOR OVERRIDING AUTOMOTIVE COMPUTER CONTROLLED CYLINDER MANAGEMENT

(71) Applicant: Brock Matthew Eastman, Chico, CA (US)

(72) Inventor: Brock Matthew Eastman, Chico, CA (US)

( * ) Notice: Subject to any disclaimer, the term of this patent is extended or adjusted under 35 U.S.C. 154(b) by 0 days.

(21) Appl. No.: 15/867,925

(22) Filed: Jan. 11, 2018

(65) Prior Publication Data

US 2018/0195448 A1 Jul. 12, 2018

Related U.S. Application Data

(60) Provisional application No. 62/444,812, filed on Jan. 11, 2017.

(51) Int. Cl.

| | |
|---|---|
| ***F02D 17/02*** | (2006.01) |
| ***F02D 41/04*** | (2006.01) |
| ***F02D 41/00*** | (2006.01) |
| ***F02P 5/15*** | (2006.01) |

(52) U.S. Cl.

CPC ..... *F02D 41/04* (2013.01); *F02D 17/02* (2013.01); *F02D 41/0087* (2013.01); *F02P 5/1512* (2013.01); *F02D 2200/604* (2013.01); *F02D 2700/058* (2013.01)

(58) Field of Classification Search

CPC ..... F02D 41/04; F02D 41/0087; F02D 41/22; F02D 41/221; F02D 41/222; F02D 17/02; F02D 17/04; F02D 13/06; F02D 2200/604; F02D 2700/058; F02P 5/1512

USPC ..... 123/198 F, 481; 701/103–105, 107, 112

See application file for complete search history.

(56) References Cited

U.S. PATENT DOCUMENTS

| | | | | |
|---|---|---|---|---|
| 5,336,609 | A * | 8/1994 | Oberto | C12N 9/2462 435/206 |
| 6,138,636 | A * | 10/2000 | Kohno | F01L 1/267 123/198 F |
| 6,688,275 | B2 * | 2/2004 | Shindou | F01L 1/267 123/198 F |
| 7,836,866 | B2 * | 11/2010 | Luken | F02D 17/02 123/481 |

* cited by examiner

*Primary Examiner* — Hai H Huynh

(74) *Attorney, Agent, or Firm* — Limor Gabay

(57) ABSTRACT

The presently disclosed subject matter relates to an apparatus which enables a use to easily and safely disable a vehicular variable cylinder management technology system, while enabling restoration of the VCM/ECO mode under certain vehicle-related conditions or driving conditions. The presently disclosed apparatus comprises a potentiometer capable of modifying the voltage input received by the vehicle sensors.

11 Claims, 3 Drawing Sheets

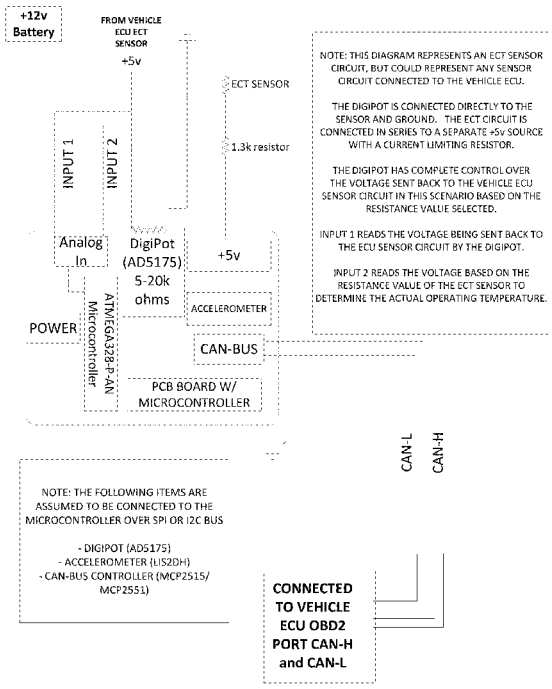

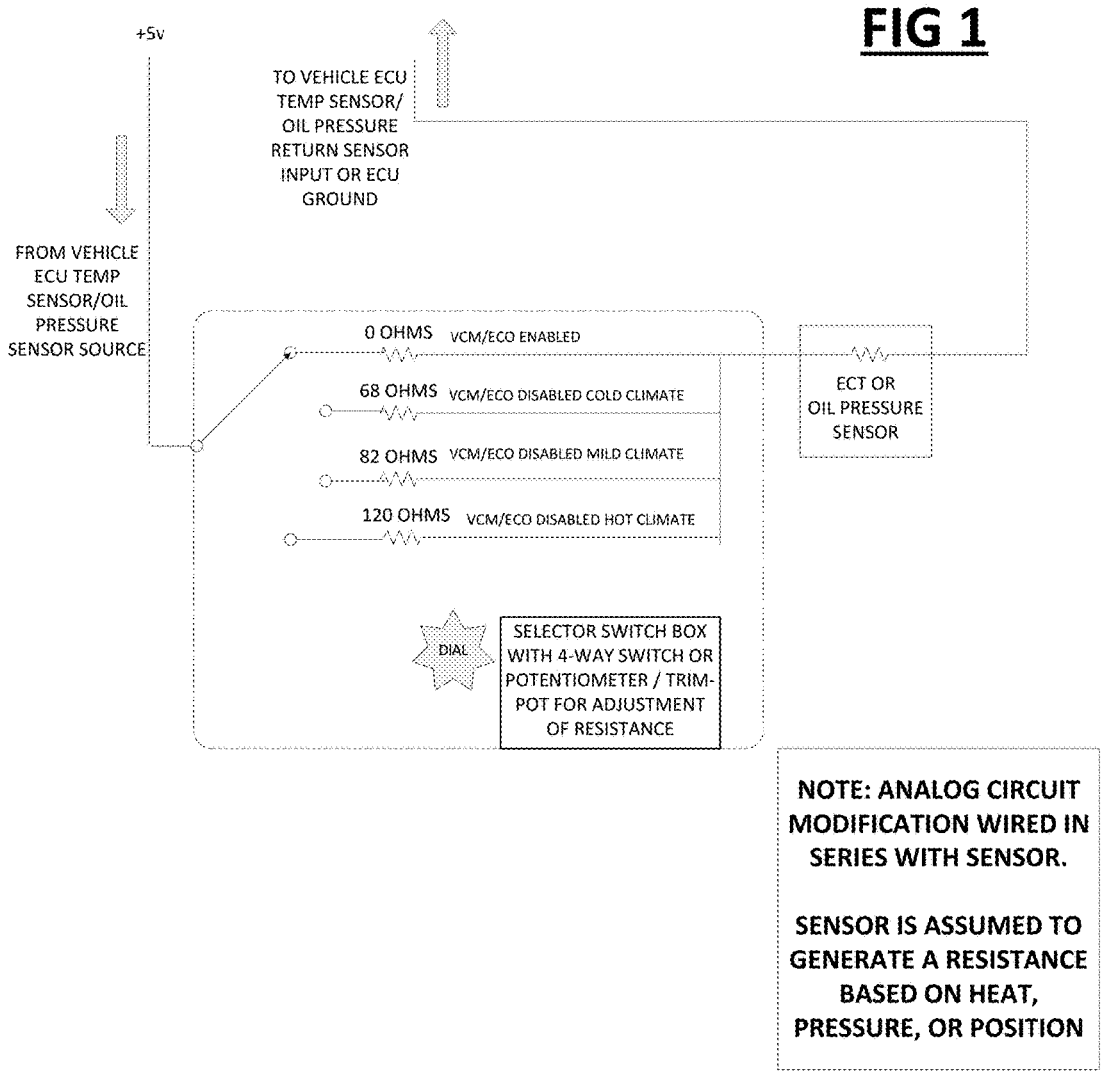
FIG 1
+5v
TO VEHICLE ECU TEMP SENSOR/ OIL PRESSURE RETURN SENSOR INPUT OR ECU GROUND
FROM VEHICLE ECU TEMP SENSOR/OIL PRESSURE SENSOR SOURCE
0 OHMS VCM/ECO ENABLED
68 OHMS VCM/ECO DISABLED COLD CLIMATE
82 OHMS VCM/ECO DISABLED MILD CLIMATE
120 OHMS VCM/ECO DISABLED HOT CLIMATE
ECT OR OIL PRESSURE SENSOR
DIAL
SELECTOR SWITCH BOX WITH 4-WAY SWITCH OR POTENTIOMETER / TRIM-POT FOR ADJUSTMENT OF RESISTANCE
NOTE: ANALOG CIRCUIT MODIFICATION WIRED IN SERIES WITH SENSOR.
SENSOR IS ASSUMED TO GENERATE A RESISTANCE BASED ON HEAT, PRESSURE, OR POSITION

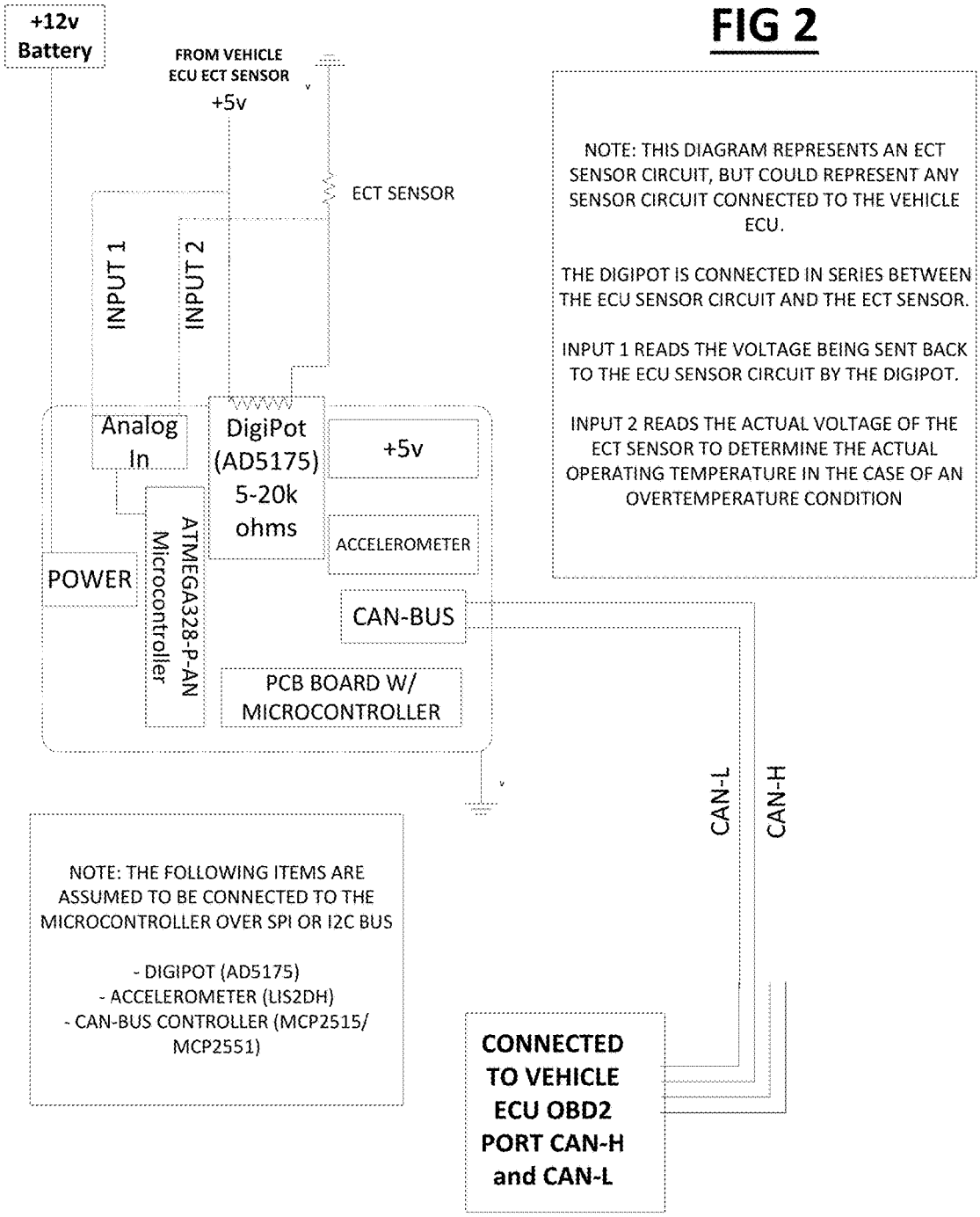

FIG 2

NOTE: THIS DIAGRAM REPRESENTS AN ECT SENSOR CIRCUIT, BUT COULD REPRESENT ANY SENSOR CIRCUIT CONNECTED TO THE VEHICLE ECU.

THE DIGIPOT IS CONNECTED IN SERIES BETWEEN THE ECU SENSOR CIRCUIT AND THE ECT SENSOR.

INPUT 1 READS THE VOLTAGE BEING SENT BACK TO THE ECU SENSOR CIRCUIT BY THE DIGIPOT.

INPUT 2 READS THE ACTUAL VOLTAGE OF THE ECT SENSOR TO DETERMINE THE ACTUAL OPERATING TEMPERATURE IN THE CASE OF AN OVERTEMPERATURE CONDITION

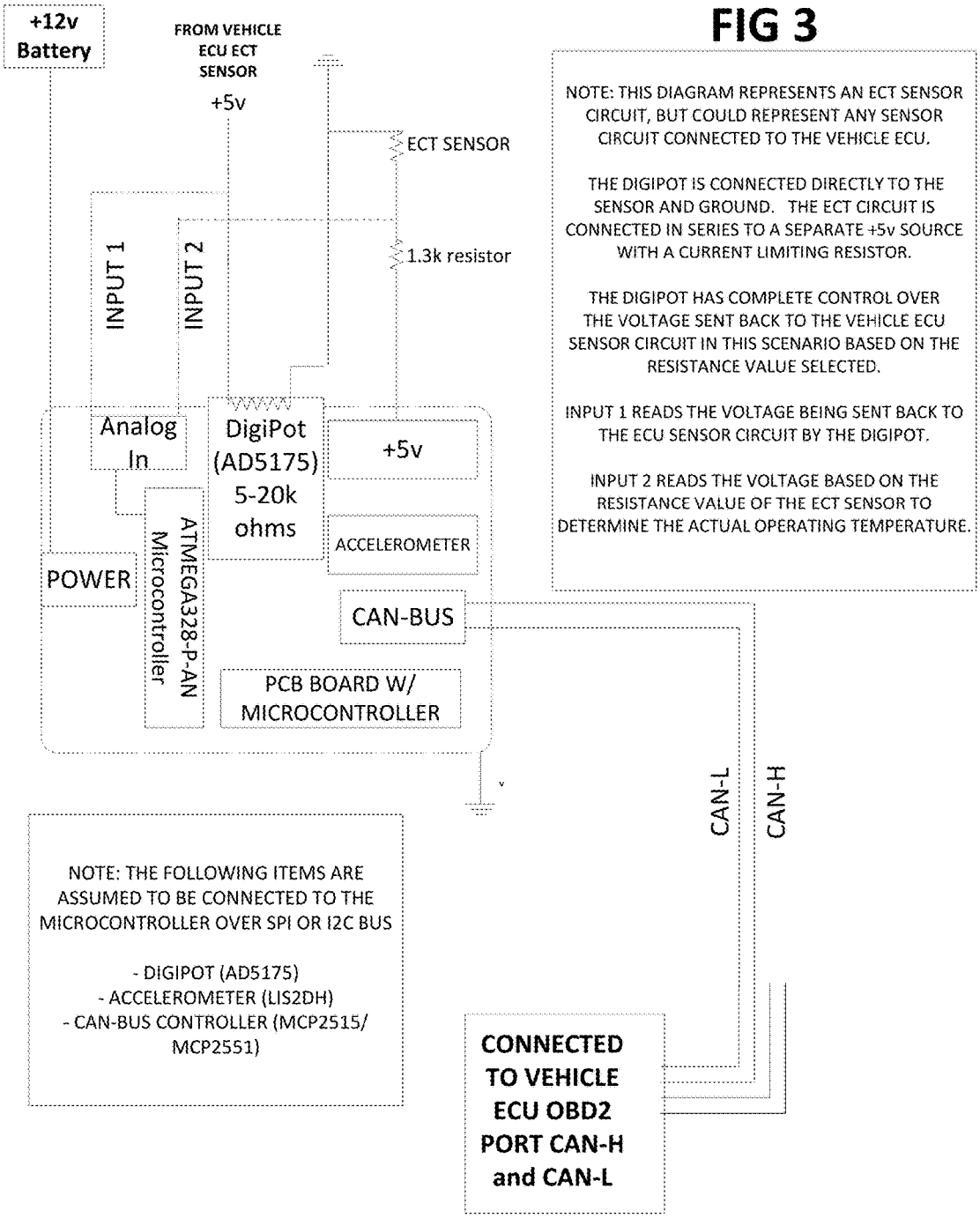

FIG 3

NOTE: THIS DIAGRAM REPRESENTS AN ECT SENSOR CIRCUIT, BUT COULD REPRESENT ANY SENSOR CIRCUIT CONNECTED TO THE VEHICLE ECU.

THE DIGIPOT IS CONNECTED DIRECTLY TO THE SENSOR AND GROUND. THE ECT CIRCUIT IS CONNECTED IN SERIES TO A SEPARATE +5v SOURCE WITH A CURRENT LIMITING RESISTOR.

THE DIGIPOT HAS COMPLETE CONTROL OVER THE VOLTAGE SENT BACK TO THE VEHICLE ECU SENSOR CIRCUIT IN THIS SCENARIO BASED ON THE RESISTANCE VALUE SELECTED.

INPUT 1 READS THE VOLTAGE BEING SENT BACK TO THE ECU SENSOR CIRCUIT BY THE DIGIPOT.

INPUT 2 READS THE VOLTAGE BASED ON THE RESISTANCE VALUE OF THE ECT SENSOR TO DETERMINE THE ACTUAL OPERATING TEMPERATURE.

METHODS AND SYSTEMS FOR OVERRIDING AUTOMOTIVE COMPUTER CONTROLLED CYLINDER MANAGEMENT

This application claims the benefit of U.S. provisional application 62/444,812, filed 11 Jan. 2017.

TECHNICAL FIELD

The presently disclosed subject matter relates to an apparatus which enables a use to easily and safely disable cylinder deactivation technology utilized in the automotive field, such as Honda's Variable Cylinder Management system.

BACKGROUND

Today's consumer automobiles utilize systems such as VCM (Variable Cylinder Management) to save fuel during specific driving conditions. Such techniques in Honda vehicles are referenced by U.S. Pat. No. 5,636,609A, and U.S. Pat. No. 7,836,866. Other automotive manufacturers have similar systems that effectively shut down a number of cylinders dynamically during operation. These systems were primarily invented to improve gas mileage performance in order to meet increasingly demanding EPA (Environment Protection Agency) regulations since the early 2000's. VCM/ECO mode is not an EPA standard, and is a manufacturer-specific in the case of Honda. GM uses a technology called AFM (Active Fuel Management) to accomplish cylinder de-activation. Dodge utilizes a technology called MDS (Multi-Displacement System) to accomplish cylinder de-activation. These VCM/ECO mode enhancements allow manufacturers to advertise unrealistic maximum MPG (Miles per Gallon) estimates for the sake of benchmarking, supposedly giving consumers a standard by which to select a vehicle for purchase. While these VCM/ECO systems (termed herein "variable cylinder management technology") have facilitated an improved gas mileage on freeway, vehicles utilizing them see an improved 1-2 miles per gallon in very specific instances. In addition, the currently available variable cylinder management technologies have caused numerous maintenance problems for users. To name some, these systems have caused increase engine vibration and oil consumption, pre-mature wear of the cylinder rings and fouling of spark plugs. More specific examples are the 2008-2013 Honda Odyssey, Pilot, Accord vehicles with 3.5 L engines that utilize variable cylinder management (VCM), and have had class-action lawsuits from VCM-2 technology in certain model years. Vehicle owners have documented engine motor and torsion mount failures every 50-80 k miles, as well as and premature torque-converter transmission failures, resulting from the variable cylinder management technology. These problems have created an undue burden on users as they substantially increased the total cost of ownership of vehicles in which the variable cylinder management technology is implemented, mainly from poorly designed parts that wear out prematurely, as well as the constant engage/disengage of the VCM/ECO systems. Normally engine and torsion motor mounts would last some 100K+ miles or the lifetime of the vehicle without issues in non VCM vehicles such as the pre-2005 Honda vehicles.

With some vehicles the VCM/ECO features can be disabled through an odb2 scan tool, such as on GM vehicles. However, with some makes of vehicles, such as Honda vehicles, such features cannot be disabled without modified firmware from the manufacturer to date.

This present disclosure focuses on work-arounds (methods enclosed herein) that a user can apply to the vehicle such as, for example, changing the signals sent from specific sensors such as a primary or secondary temperature (ECT) and/or oil pressure sensors to fool the computer into disabling the VCM/ECO (or any variable cylinder management technology) like features, thus avoiding secondary problems for the vehicle. The methods of the present disclosure disable the variable cylinder management technology without issuing a check-engine light, and enable working in all climates. Normally, disabling these systems requires modifying the resistance of a particular sensor circuit, thus changing the voltage returned to a specific vehicle ECU sensor. However, different climates and temperatures under the hood make it difficult for a single resistance modification value to work in all scenarios.

Due to the difficulty of existing methods to disable the variable cylinder management technologies, many users have no other option but to leave a check-engine light on the vehicle and disabling some known sensors documented by manufacturer diagnostic troubleshooting manuals to turn these VCM/ECO (or any other variable cylinder management technology) features off. However, this creates an annoyance and may even invalidate warranties issued by manufacturers. For most vehicles, it is unlikely the automotive manufacturer will disable these features due to previously advertised EPA MPG (Miles Per gallon) standards, which might result in fines to the manufacturer.

Therefore, consumers are desperate to find ways to 'hack', or manipulate, the external feedback systems to the computer to disable these systems without triggering a check engine light. These manipulations may not be supported by the manufacturer and may void warranties, but beyond the 3 year, 36,000 mile standard warranty on a vehicle, the consumer is liable for the defects beyond the warranty period. A plug-and-play method to allow the consumer to enable/disable these features is necessary, especially where it can be added and removed within a matter of minutes when taking the vehicle in for regular maintenance.

As an example, some users discovered that VCM type features were disabled on some vehicles until they were completely warmed up to normal operating temperature and made plug-in harnesses that would reduce the reported temperature sent to the vehicle ECU to keep the temp (ECT) below a specific point and disable VCM/ECO using an inline resistor, which is wired in series with the ECT sensor. However, these technologies would not work in all climates and instances, due to factory variances with resistance in coolant temperature sensors, outside temperatures in warmer climates, vehicle sitting in traffic with the A/C on, and colder climates.

A solution is needed that would disable VCM in all scenarios without compromising the remaining systems that a user could easily adjust based on the seasons and conditions. The methods disclosed herein provide a much-needed solution to enable the vehicle user to decide on how to deal smartly and easily with their vehicle variable cylinder management technologies.

SUMMARY

The presently disclosed subject matter relates to an apparatus which enables a use to easily and safely disable a vehicular variable cylinder management technology system. In some embodiments, the present disclosure provides an apparatus for modifying operation of a vehicle variable cylinder management technology system comprising:

a potentiometer wherein the potentiometer is either an analog rotary switch potentiometer with independent resistors or an analog potentiometer and wherein said potentiometer has an adjustment range capable of accounting for seasonal variances and sensor calibration variances, and, wherein said potentiometer is capable of modifying the voltage returned by one or more sensor(s) utilized by the vehicle variable cylinder management technology system; and thus manipulate the vehicle variable cylinder management technology system operation.

In some embodiments, the apparatus of the present disclosure manipulates the vehicle variable cylinder management technology into disabling VCM/ECO mode In some embodiments, the apparatus of the present disclosure comprises a removable cover to environmentally protect the apparatus adjustment mechanism from dirt, grease or debris when the apparatus is located in the engine compartment.

In yet other embodiments of the presently disclosed apparatus for modifying operation of a vehicle variable cylinder management technology system it comprises one or more digital potentiometer or a digital rheostat, wherein said potentiometer/s or rheostat are connected to a microcontroller, and wherein said digital potentiometer/s or digital rheostat can automatically adjust resistance on one or more circuits based on feedback to microcontroller such as voltage of a sensor circuit; and, where said digital potentiometer or digital rheostat is capable of modifying the voltage returned by one or more sensor(s) utilized by the vehicle variable cylinder management technology system; and, thus manipulate the vehicle variable cylinder management technology system operation.

In some embodiments of the presently disclosed apparatus, it is able of turning the VCM/ECO mode on/off based on data selected from a group comprising data received from the OBD2 diagnostic port by the microcontroller, data received by the automotive can-bus network by the microcontroller when the vehicle is actively moving, data based on engine RPM, data based on engine load or data based on vehicle speed.

In some embodiments, the present disclosure provides an apparatus for modifying operation of a vehicle variable cylinder management technology system wherein said apparatus comprises further comprising a 2 or 3 axis accelerometer, and wherein the said apparatus ability to turn the VCM/ECO mode on or off is based on data received from said 2 or 3 axis accelerometer which is connected to the microcontroller, and wherein the 2 or 3 axis accelerometer enables said apparatus to detect if the vehicle is actively moving, without receiving output from the OBD2 diagnostic port or automotive can-bus network.

In some embodiments of the presently disclosed apparatus, said apparatus is capable of turning the VCM/ECO mode on or off based on voltage measured from other sensors, such as a speed sensor by the microcontroller independent of an input from the OBD2 diagnostic port or automotive can-bus network.

In some embodiments of the presently disclosed apparatus, said apparatus is capable of returning the circuit to a normal reporting state when an abnormal condition is detected on the circuit while being modified by said apparatus, independent from the OBD2 diagnostic port or automotive can-bus network.

In some embodiments of the presently disclosed apparatus, said apparatus is able to utilize any existing button or switch connected to the automotive can-bus network to manipulate the vehicle variable cylinder management technology system, such as buttons on the steering wheel or dashboard.

In some embodiments of the presently disclosed apparatus, said apparatus alarms the user if an unusual condition related to the vehicle or its operation has occurred by sending data using the automotive can-bus network which is connected to a LED display integral to the vehicle, button or gauge on the dashboard.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

FIG. 1 illustrates a diagram of a basic rotary switch connected to separate resistors wired in-line with a sensor such as a coolant temperature sensor or oil pressure sensor.

FIG. 2 is a diagrammatic illustration of a microcontroller connected to a digital potentiometer; the microcontroller contains analog inputs which when connected to the sensor circuit voltage are fed back to the vehicle's ECU, the microcontroller can adjust the digital potentiometer to keep the circuit voltage within a specific range.

FIG. 3 is a diagrammatic illustration of a microcontroller connected to a digital potentiometer; in this design—'proxy mode'—the potentiometer can be connected to the feedback loop to a particular sensor connected the vehicle ECU.

DETAILED DESCRIPTION

For purposes of explanation, numerous specific details are set forth in order to provide a thorough understanding of the description. It will be apparent, however, to one skilled in the art that embodiments of the disclosure can be practiced without these specific details. In some instances, modules, structures, processes, features, and devices are shown in block diagram form in order to avoid obscuring the description. In other instances, functional block diagrams and flow diagrams are shown to represent data and logic flows. The components of block diagrams and flow diagrams (e.g., modules, blocks, structures, devices, features, etc.) may be variously combined, separated, removed, reordered, and replaced in a manner other than as expressly described and depicted herein.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

The presently disclosed subject matter relates to an apparatus which enables a use to easily and safely disable a vehicular variable cylinder management technology system, while enabling restoration of the VCM/ECO mode under certain vehicle-related conditions or driving conditions.

For the purpose of the present disclosure, a "variable cylinder management technology system" is any an automobile engine technology that allows the engine displacement to change, usually by deactivating cylinders, for improved fuel economy. Manufacturers may use alternative terms to describe these systems, unlimiting examples include MDS (Dodge) and VCM (Honda).

By "VCM/ECO mode" is meant all aspects of the operation and function of the vehicle under the control of the variable cylinder management technology system.

The presently disclosed subject matter provides a solution to enable vehicle users to decide on how to deal with their vehicle variable cylinder management technologies and comprises a device and method of use thereof. In an embodiment, the presently disclosed apparatus comprises a variable resistor type circuit, such as an analog or digital potentiometer, which can also be called a digital or analog rheostat. In some preferred embodiment, the presently disclosed device is an apparatus (box) with a rotary switch which is connected to different resistors based on a setting or an actual analog potentiometer, it allows the user to choose different resistance values by simply turning the dial and locating the dial inside of the engine compartment for seasonal adjustments (which are based on some known tested exact resistance values) In other embodiments, the box can be mounted in the dash area for user enabled manipulation while the vehicle is running. In a preferred embodiments, the presently disclose apparatus interacts with vehicle sensors to enable manipulation of the variable cylinder management technology system. The following sensors and systems have been noted as variables in the operation of the variable cylinder management technology system and may be manipulated, directly or indirectly, to disable or enable the VCM/ECO mode.

a. Vehicle speed sensor
b. Engine Speed (RPM)
c. Engine operational temperature
d. Engine loading and torque sensors
e. Vehicle acceleration
f. Slope rate of the vehicle
g. Engine idling condition
h. Engine oil pressure
i. Engine Misfires—e.g. spark plugs or coil
j. Check Engine light/ODB2 code
k. VCM Solenoid Status
l. VCM Solenoid Return Value In some embodiments, a potentiometer comprising a rotary switch with locked-in preset positions utilizing high-tolerance resistors is preferable to a standard analog potentiometer because most analog potentiometers could be accidentally bumped by the user and then cause the system to have unknown consequences if the resistance values are too low or too high. The rotary switch with different connected resistors may be more reliable and can be designed better to accommodate each specific system of the vehicle with very specific tuning.

It is also possible to utilize a digital potentiometer, also known as a "digipot" and adjust the resistance on the fly (as needed) instead of having the vehicle user make manual adjustments. In some embodiments, the digital potentiometer is connected to a small embedded micro-processing board, which contains software programmed to adjust the resistance of the circuit based on inputs fed back to the micro-processing board (microcontroller). Those inputs can be voltage measured on the sensor circuit being modified by the microcontroller, voltage measured on a separate sensor circuit from the circuit being modified, sensors connected to said microcontroller like an accelerometer, and input such as data from the vehicle OBD2/Can-Bus network connected to the microcontroller. In this example, the microcontroller reads the voltage of an ECT (Engine Coolant Temperature) sensor, and adjusts the resistance value of the digipot connected in series with the circuit to be modified be within a discrete voltage range. This allows specific voltage ranges to be returned to the ECT sensor, keeping the VCM/ECO mode disabled and not triggering any diagnostic problem codes by the vehicle. However, in some embodiments, if the microprocessing unit senses an above normal engine operating temperature in the case of modifying an ECT (Engine Coolant Temperature) circuit, the digipot resistance is adjusted by the microcontroller to a value which allows the ECT sensor to operate as if no modification is present. Therefore, the use of a digipot connected to a microcontroller allows disabling of the variable cylinder management technology system and does not interfere with the normal operation of the vehicle when an abnormal condition is observed. This is desirable to keep the temperature gauge working properly in an over-temperature scenario from issues such as, but not limited to, a blown head gasket or low coolant in the case of an ECT sensor.

As an example, a small PCB circuit board designed with a rotary switch can emulate a potentiometer with 4-10 presets. Thus, accommodating the ability to completely remove any resistance on a user configurable setting aimed to re-enable the VCM/ECO mode, when, for example, a smog check or diagnostic machine needed to be used on the vehicle. Other settings facilitated by the use of the said PCB board simply allow the user to go from lower resistance to higher resistance values to deal with climate issues or calibration issues, and to make sure the VCM/ECO mode was disabled. This serves also to enabling the temperature gauge on the dashboard to work correctly when the temperature sensor (ECT) was the target sensor for manipulating the variable cylinder management technology system. Such circuit board may be fine-tuned to work in all climates without having to de-install the unit or make multiple plug-and-play dongles that have to be plugged into the wire-harness of the computer, thus causing users frustration and in addition, only providing the ability to disable the VCM/ECO mode certain parts of the year. In some instances, if the operating temperature sensed by the computer was about 5-8 degrees Celsius less than normal operating temperature of the vehicle, the VCM/ECO mode would not necessarily engage, due to the operation of the presently disclosed apparatus. This 5-8 degrees Celsius may not even noticeable to the user on the dash gauge and did not generate a check engine light. The actual operating temperature of the vehicle is unchanged with this method by modifying a circuit like the ECT (Engine Coolant Temperature), only the ECU believes the operating temperature is lower for this sensor. In some embodiments of the present apparatus, comprising a digital potentiometer, a user can utilize an ODB2 bluetooth/Wifi module which communicates with a microprocessor (microcontroller) such as, without limitation, an Arduino board with Bluetooth/Wi-fi capability, and thus the sensed temperature of the ECU is reported to a microcontroller processor (such as Arduino), which then adjusts a digital potentiometer circuit to constantly compensate for the temperature offset. This setting allows for an incredibly precise method of always keeping the temperature just a degree below the temperature required to engage the VCM/ECO mode. In some embodiments comprising such ODB2 bluetooth/Wi-fi module, a cellphone with Bluetooth or Wi-fi capability can be used to program the microcontroller board to enable or disable VCM/ECO mode features based on vehicle speed, overheating temperature cutouts/cutoffs, or to re-enable the VCM/ECO mode operation and disable the override.

One of the only advantages of variable cylinder management technology system is normally on the highway at speeds over 45 mph. Unfortunately, most users see the variable cylinder management technology system kick in at any speed above 25 mph, when the VCM/ECO mode only provides a negligible mileage improvement and would cause more wear/damage per dollar than fuel savings over time. These VCM/ECO mode features could be disabled by feedback from a ODB2 sensor using Bluetooth/Wi-Fi or directly wired over a serial terminal to a microcontroller, or over a can-bus network and only engage VCM/ECO mode features when the average speed exceeds a certain threshold, by changing the resistance level of the digital potentiometer on the fly (as needed), and so minimize the VCM/ECO mode operation to only times when it's actually beneficial.

In another embodiment of the presently disclosed apparatus, the oil pressure sensor is adjustable via analog or digital potentiometers and/or microcontrollers to a value just below the threshold of the variable displacement technology system engaging oil pressure algorithm, but, at the same time, still allow for normal operation of the vehicle without a check engine light or any complications with the engine function. For instance, some Honda Accord users reported being some 2.5 qts low on oil on their engine, no check engine light and no VCM/ECO mode enabled, so this is a feasible method of modification to one of the oil pressure sensors, including the VCM Oil Pressure Switch.

In some embodiments, the presently disclosed apparatus utilizes an on/off switch in the dashboard area accessible to the driver in conjunction with the analog rotary switch potentiometer or with a digital potenetiometer described above, wherein said potentiomenter is integrated with a microcontroller located within the engine compartment or in the cabin of the vehicle for driver convenience of use.

As mentioned above, the present apparatus may comprise an analog potentiometer (also known in the art as a trim-pot) to provide adjustments manually to override the variable cylinder management technology system. In some embodiments, a protective removable cover is needed to protect the dial area where said apparatus it is located under the hood to keep dirt, grease and debris out of the adjustment mechanism. Additionally, large amounts of heat are generated under the hood which needs to be dissipated. Thus, a larger wire size than normal is used to connect the potentiometer to the wiring harness for improved heat dissipation. A person skilled in the art will appreciate that any suitable diameter or type of wire may be used.

As mentioned above, the present apparatus may comprise a digital potentiometer, which is basically a variable resistor—also known in the art as a "digipot". The digipot is connected to a microcontroller such as, for example, an Arduino microcontroller (ATMEGA328-P) from microchip, inc. Those skilled in the art will know a "digipot" can be utilized in two modes: rheostat mode (use of two terminals) and conventional potentiometer mode (3 terminals) to be configured to best to work with each individual sensor based on the voltage levels to be modified. Those skilled in the art will appreciate that a digipot is normally connected to a microcontroller through an industry standard protocol such as SPI or i2c. The use of a digipot in this apparatus, compared to an analog potentiometer, minimizes driver intervention, as the digipot voltage can be automatically compensated by the microcontroller to deal with any circuit variation. The digipot, microcontroller, and components such as accelerometers and can-bus controllers, are all contained on a printed circuit board and housed in an enclosure which provides protection from the harsh environment under the vehicle hood; the enclosure however, could also reside within the cabin of the vehicle. Connectors from the microcontroller PCB board are connected to sensors; either in-line (serial) or in a 'proxy method' as defined below. Normally microcontrollers will require a +12 v from the battery of the vehicle, or are powered from a switched source under the hood. In automotive environments, circuit protection must be provided with Op-amps, TVS (Transient Voltage Suppression) capacitors and resistors, which minimize voltage variation on circuits connected to components on the microcontroller circuit board and the vehicle ECU. Those skilled in the art of automotive design would incorporate adequate protection into any circuit interfacing with the vehicle ECU.

Referring to FIG. 1, a diagrammatic illustration is shown of a basic rotary switch connected to separate resistors wired in-line with a sensor, such as a coolant temperature sensor or oil pressure sensor, which can re-enable normal VCM/ECO mode operation or disable VCM/ECO normal operation. The apparatus illustrated comprises components that allow the user to configure the VCM/ECO mode to be disabled in different times of the year or climates.

Now referring to FIG. 2, an illustration of a microcontroller connected to a digital potentiometer is shown. The microcontroller contains analog inputs which read the circuit voltage which is fed back to the vehicle's ECU and adjusts the digital potentiometer so to keep the circuit voltage within a specific range. This method can be used with other circuits related to VCM/ECO mode, such as, read voltage from coolant/oil/other sensors; and dynamically adjust the resistance.

In some embodiments of the present apparatus, the digipot is wired in series with a sensor circuit such as the ECT circuit (as illustrated in FIG. 2). In the embodiment illustrated in FIG. 3 the potentiometer used is digipot" in a rheostat mode using two terminals, to make a variable resistor. The microcontroller is utilizing an analog input to read the circuit voltage to determine how many steps the digipot will need to be increased or decreased on the resistance. A digipot such as an Analog Devices AD5175 has 1024 positions and can be incremented or decremented in 10 ohm steps with a maximum resistance of 10 k ohms, completely emulating the range of an ECT sensor. Wiring this digipot in series with an existing circuit (ECT coolant or Oil Pressure Sensor) allows the microcontroller to adjust the resistance of the steps precisely. The microcontroller uses the analog inputs to read the actual voltage being fed back to the vehicle's ECU and reacts to the changes from the actual sensor quite rapidly by re-adjusting the digipot resistance to maintain the voltage within a specific range. This method works as long as the microcontroller adjusts the digipot to react to voltage changes within the entire circuit quickly enough to keep the VCM/ECO mode disabled by limiting the voltage range fed back to the vehicle ECU (Engine Control Unit).

FIG. 3 illustrates yet another embodiment of the present apparatus, wherein a microcontroller connected to a digital potentiometer. In this design—'proxy mode'—the potentiometer can be placed between the entire feedback loop to a particular sensor connected to the vehicle ECU. An analog input is used to read the voltage being fed back to the vehicle ECU, so to keep it within a specific range. A separate circuit is then connected to the actual sensor. In this method the microcontroller has complete control over the voltage returned to the vehicle ECU, and thus can emulate the actual sensor connected to the microcontroller, whose voltage is read on a separate analog input circuit. The microcontroller can adjust the digipot voltage to mimic the voltage returned by the independent ECT circuit connected to the microcontroller. The main advantage is the microcontroller can now set limit points to keep voltage within specific ranges regardless of what the actual ECT circuit voltage may be.

In some embodiments, generally illustrated in FIG. 3, the digipot can be wired directly to a specific vehicle sensor ECU feedback circuit using the two pins in rheostat mode, bypassing the intended sensor (ECT or Oil Pressure Sensor). (See FIG. 3). Such wiring is referred to herein as 'proxy mode', upon wiring the digipot will emulate the actual sensor voltage as controlled by the microcontroller. The vehicle ECU simply reads voltages from sensor circuits and map voltages to an arbitrary number based on the circuit type (e.g. 1 v=70 c in the case of an ECT circuit). The digipot is connected to a microcontroller; an analog input on the microcontroller can read the actual voltage the digipot is feeding back to the vehicle ECU. The actual sensor (such as an ECT circuit or Oil Pressure Circuit) can be fed a separate +5 v signal or other voltage reference from the microcontroller, connecting a separate analog input to read the voltage out of the intended sensor (ECT, Oil Pressure Circuit). The microcontroller can then adjust the digipot resistance to feed the vehicle ECU, for example, the identical voltage of the intended circuit if so desired. In this manner, the microcontroller has complete control over the feedback circuit to the vehicle ECU. In this manner also the voltage levels can be kept within a specific range 100% of the time based on software programming; thus limits can be set on what voltages are sent back to the vehicle ECU sensor based on the voltage levels desired regardless of what the actual sensor is reporting. In the embodiment comprising ECT circuit, (as diagrammed in FIG. 3) this setting be used to programmatically bounce the temperature needle on the dash up and down if the engine coolant temperatures rapidly increase and decrease, and thus alert the user to a low coolant level on vehicles without a low coolant sensor based on an instability or fluctuation of the voltage of the real ECT (Engine Coolant Temperature) circuit. Similarly, this embodiment can be used for rapidly changing oil pressures assuming an oil pressure gauge is present on the dash. As described above, if an over temperature condition occurred in an ECT circuit or a low-oil condition in an Oil Pressure Circuit, it is necessary that the gauges operate normally to alarm the user of the vehicle of this condition and mimic the real sensor, regardless of whether VCM/ECO mode was active or inactive. In the case of an over-temperature condition in an ECT circuit (such as, for example, 0.4 v or higher than a 215 F temperature) the digipot would then adjust the resistance value to match the voltage of the real ECT circuit and alert the vehicle ECU to the over temp condition.

In the proxy mode as described herein, the microcontroller simply needs to adjust the digipot to a voltage that keeps the vehicle ECU VCM/ECO mode disabled and also keeps the check engine light off, in the case of the ECT circuit embodiment, such lights can be for example, an engine below operating temperature check engine light (P0128 code). In the proxy method, the digipot is always engaged back into the vehicle ECU circuit, unless an SPDT (Single-Pole Double-Throw) switch is used or installed on the microcontroller to toggle the circuit between the digipot input and the actual sensor circuit, or the intended ECT sensor. It should be noted that in the 'proxy mode', the digipot must emulate the voltages sent back to the vehicle ECU even during warmup. The digipot must always be powered up even when the vehicle is off, such that the ECU always sees a return voltage. Thus, power save mode on the microcontroller and digipot will need to be used to minimize parasitic battery drain, unless an SPDT-NC switch can be utilized to connect the real ECT sensor back to the ECU circuit, which can be done if the microcontroller circuit were connected to a key-ignition source which would turn the microcontroller on and off. The microcontroller therefore has a complete picture of the voltage in the circuit, and how adjusting the digipot resistance up or down changes that voltage. With this in mind, the microcontroller through the digipot can now dynamically turn on and off the VCM/ECO mode option back and forth within microseconds by adjusting the voltage feedback to the vehicle ECU circuit, which relates to a real value in the case of an ECT circuit (e.g. 0.74 v=182 F). As described earlier, if the ECU sees a voltage corresponding lower than a 167 F temperature (75 c, corresponding to approximately 0.93 v) the VCM/ECO mode is disabled at temperatures below this on the ECT circuit. The VCM/ECO oil pressure circuit also can also disable the VCM/ECO if the pressure is below 15 psi (0.4 v) on some vehicle models to protect the engine from damage.

In some embodiments, the apparatus presently disclosed, can enable and disable the VCM/ECO mode dynamically by modifying one or more sensors, using the digipot to modify a sensor circuits voltage only when necessary to prevent VCM/ECO mode engagement (instead of having the particular sensor always modified during operation) which minimizes impacts to normal vehicle operation. This present apparatus can function based on input related to factors such as engine load, vehicle speed, engine RPM, or any engine variable accessible by the microcontroller. This is advantageous when maintaining emissions compliance, avoiding triggering check engine lights and periodic calibration of other vehicle sensors like TPS (Throttle Position Sensor). In some embodiments, the microcontroller is connected to the vehicle OBD2 diagnostic port over Bluetooth, serial, or another connection method, which can use variations of the can-bus protocol as invented by Robert Bosch. The OBD2 port has access to the high and low-speed automotive can-bus which contains relevant data to determine if the vehicle is moving, and if it does is it above or below a specific speed, using such parameters as engine RPM or engine load. As an example of the operation of the present apparatus, changing the voltage of the ECT or Oil Pressure circuits microseconds before the engine load goes below a specific value (such that would normally engage VCM/ECO mode) would keep the VCM/ECO mode disabled. In some embodiments, other sensors such as the mass-airflow sensor could be connected directly into an additional analog input on the microcontroller to determine the approximate speed (e.g. 1 v=25 mph).

In some embodiments, an accelerometer measures vibration and change in acceleration. A 2 or 3 axis accelerometer is connected to the microcontroller over SPI, i2c or analog, and can be utilized to determine if the vehicle is in motion, provide an approximation of vehicle speed and also estimate engine RPM in some cases. The advantage of the accelerometer vs can-bus, is that the accelerometer may provide the necessary data to the microcontroller for adjusting the digipot resistance without the added expense and time to tap into the vehicle can-bus, because the accelerometer can be installed on the microcontroller PCB board. An accelerometer utilized in such manner allows for the microcontroller to engage and disengage the VCM/ECO mode dynamically as the microcontroller can reliably determine if the vehicle is moving or not moving, estimated vehicle MPH, or an estimated engine RPM which determines the vehicle is stopped.

In some embodiments, a microcontroller with an integrated can-bus controller such as a microchip MCP2515, is connected to the vehicle high or low speed can-bus and allows the driver to utilize an existing button within the vehicle to turn on and off the VCM/ECO mode and thus act as an override. The majority of Honda's have a cruise-cancel button which is a momentary press type of button which will send out a broadcast on the can-bus telling the remaining systems this button is currently being held. As an example, if a driver wanted to re-engage VCM/ECO operation for a period of time, the cruise-cancel button could be held down, for example, for 4 seconds at which time the software on the microcontroller recognizes this signal on the can-bus and switches the digipot value to show the normal operational temperatures on an ECT or Oil Pressure circuit. The driver can then disable VCM/ECO operation again by pressing down the same cruise-cancel button for about 4 seconds, toggling the mode of the VCM/ECO on the microcontroller. This is a simple example, but any button within the vehicle connected to the can-bus could be utilized in such manner which eliminates the need to install additional buttons or switches.

It is expressly contemplated herein that a user, such as a car owner, driver or mechanic, is able to install the apparatus disclosed herein in the different installation embodiments disclosed above and in the drawings, and perform all the steps and functions required for the operation of said apparatus.

What is claimed:

1. An apparatus for modifying operation of a vehicle variable cylinder management technology system comprising:

a potentiometer wherein the potentiometer is either an analog rotary switch potentiometer with independent resistors or an analog potentiometer and wherein said potentiometer has an adjustment range capable of accounting for seasonal variances and sensor calibration variances, and, wherein said potentiometer is capable of modifying the voltage returned by one or more sensor(s) utilized by the vehicle variable cylinder management technology system; and, thus manipulate the vehicle variable cylinder management technology system operation.

2. The apparatus of claim 1, wherein said apparatus manipulates the vehicle variable cylinder management technology into disabling VCM/ECO mode.

3. An apparatus according to claim 1, wherein said apparatus comprise a removable cover to environmentally protect the apparatus adjustment mechanism from dirt, grease or debris when the apparatus is located in the engine compartment.

4. An apparatus for modifying operation of a vehicle variable displacement technology system comprising:

one or more digital potentiometer or a digital rheostat, wherein said potentiometer/s or rheostat are connected to a microcontroller, and wherein said digital potentiometer/s or digital rheostat can automatically adjust resistance on one or more circuits based on sensor inputs connected to microcontroller; and, where said digital potentiometer or digital rheostat is capable of modifying the voltage returned by one or more sensor(s) utilized by the vehicle variable cylinder management technology system; and, thus manipulate the vehicle variable cylinder management technology system operation.

5. The apparatus of claim 4, wherein said apparatus manipulates the vehicle variable cylinder management technology into disabling VCM/ECO mode.

6. The apparatus of claim 4, wherein said apparatus is able of turning the VCM/ECO mode on/off based on data selected from a group comprising data received from the OBD2 diagnostic port by the microcontroller, data received by the automotive can-bus network by the microcontroller when the vehicle is actively moving, data based on engine RPM, data based on engine load or data based on vehicle speed.

7. The apparatus of claim 4, further comprising a 2 or 3 axis accelerometer, and wherein the said apparatus ability to turn the VCM/ECO mode on or off is based on data received from said 2 or 3 axis accelerometer which is connected to the microcontroller, and wherein the 2 or 3 axis accelerometer enables said apparatus to detect if the vehicle is actively moving, without receiving output from the OBD2 diagnostic port or automotive can-bus network.

8. The apparatus of claim 4, wherein said apparatus is capable of turning the VCM/ECO mode on or off based on voltage measured from other sensors connected to the vehicle by the microcontroller independent of an input from the OBD2 diagnostic port or automotive can-bus network.

9. The apparatus of claim 4, wherein said apparatus is capable of returning the circuit to a normal reporting state when an abnormal condition is detected on the circuit while being modified by said apparatus, independent from the OBD2 diagnostic port or automotive can-bus network.

10. The apparatus of claim 4, further comprising the ability to utilize any existing button or switch connected to the automotive can-bus network to manipulate the vehicle variable cylinder management technology system, such as buttons on the steering wheel or dashboard.

11. The apparatus of claim 4, wherein said apparatus alarms the user if an unusual condition related to the vehicle or its operation has occurred by sending data using the automotive can-bus network which is connected to a LED display integral to the vehicle, button or gauge on the dashboard.

* * * * *